United States Patent [19]

Apellaniz

[11] 4,189,068

[45] Feb. 19, 1980

[54] PERFORATING AND SEALING DEVICE FOR CARBON DIOXIDE CAPSULES AND SUCHLIKE

[75] Inventor: Ramon Apellaniz, Lasne-Chapelle-Saint-Lambert, Belgium

[73] Assignee: Waterlomat, Societé Anonyme, Brussells, Belgium

[21] Appl. No.: 821,321

[22] Filed: Aug. 2, 1977

[30] Foreign Application Priority Data

Sep. 30, 1976 [BE] Belgium ..... 255343

[51] Int. Cl.[2] ..... B67B 7/24

[52] U.S. Cl. ..... 222/83.5; 222/399

[58] Field of Search ..... 222/5, 83.5, 83, 80, 222/399; 141/19

[56] References Cited

U.S. PATENT DOCUMENTS

| | | | |
|---|---|---|---|
| 2,205,938 | 6/1940 | Ward | 222/83 X |
| 2,249,796 | 7/1941 | Thomas | 222/5 |
| 3,014,619 | 12/1961 | Moran | 222/5 |
| 3,161,322 | 12/1964 | Stone | 222/5 |

*Primary Examiner*—Robert J. Spar
*Assistant Examiner*—Frederick R. Handren
*Attorney, Agent, or Firm*—Bacon & Thomas

[57] ABSTRACT

The invention pertains to a perforating and sealing device for carbon dioxide capsules and suchlike, it comprises a capsule support; in this support is a bore for an axially movable piston, for the purpose of capping the collar of the capsule; the piston is provided with an axial passage; a perforating element extends partially into that passage and is movable toward the capsule until the latter is perforated, the piston being then firmly pressed against the capsule by the gas pressure in the bore.

7 Claims, 4 Drawing Figures

PERFORATING AND SEALING DEVICE FOR CARBON DIOXIDE CAPSULES AND SUCHLIKE

The present invention pertains to a perforating and sealing device for carbon dioxide capsules and suchlike, as well as to the applying of this device to portable apparatus for drawing-off soda drinks.

Various types of apparatus are known in which the energy required for their operation is supplied by carbon dioxide under pressure, this gas being supplied by commercially available capsules. Such apparatus are, for instance, portable apparatus for drawing-off soda drinks from containers such as metal cans, casks of plastic materials, etc.

In such apparatus, the capsule must be inserted in a chamber, the closure—sealed—of which entails the perforation of the capsule. At the risk of losing all the gas, this chamber may not be opened as long as the apparatus is loaded. Moreover, such a premature opening of the chamber may be quite dangerous for the operator.

A first purpose of the invention is to supply a perforating and sealing device which does not have the above-mentioned disadvantages of the known devices.

On the other hand, all the commercially available capsules have a content of 12 g, only one manufacturer at present offering 24 g capsules. Mainly for technological reasons, a 24 cc capsule is more expensive than two 12 cc capsules.

Now, to draw-off drinks which are practically saturated with $CO_2$, from containers of approximately 5 liters, it is necessary to have about 24 g of $CO_2$ available.

A second purpose of the invention is therefore to supply a device which permits, in one single operation, to perforate two capsules of 12 g each, whilst assuring for each of them a perfect sealing, despite the considerable dimensional tolerances found in the commercial capsules.

Generally speaking, a device according to the invention comprises a capsule support; in this support, a bore for an axially moveable piston, for the purpose of capping the neck of the capsule; this piston being provided with an axial bore; a perforating element extending partially in aforesaid bore; and a means for bringing together aforesaid perforating element and the capsule until the latter is perforated, aforesaid piston then being firmly fitted against the capsule by the gas pressure in aforesaid bore.

On the other hand, a drawing-off apparatus according to the invention is characterized by the fact that it comprises two devices as described above, located side by side and provided with common means for bringing the capsules together with their perforating elements.

For easier comprehension, the invention will be described hereinafter in greater detail, with reference to the appended drawings of examples, in which:

FIG. 2 is a partially stripped top view of a drawing-off apparatus for soda drinks, incorporating two devices according to the principle of FIG. 1;

FIG. 1 illustrates the principle of a perforating and sealing device according to the invention.

Figure 1:
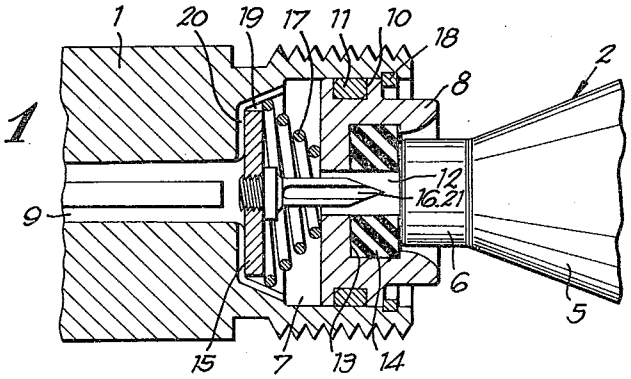
FIG. 1 is a schematic section of a perforating and sealing device according to the invention.

It comprises a support 1 (part of which only is shown in this Figure) for a capsule 2 of carbon dioxide.

This capsule 2 is of the well known commercial type, with a content of 12 g. It has a cylindrical body 3 terminating at one end by a hemispherical bottom 4, and at the other end, by a conical part 5 extended by a cylindrical neck 6.

Part of support 1 comprises a bore 7 in which is fitted an axially moveable piston 8. A gas passage 9 opens up in this bore 7 and is intended for the evacuation of the gas from the capsule towards its location of use.

Piston 8 is provided with a peripheral groove 10 in which is fitted a sealing O-ring 11, as well as with a central bore 12 with a counterbore 13 in which is fitted a sealing ring 14.

At the bottom of the bore there is provided a disc 15 through which passes a perforating rod 16. A spring 17 is provided between disc 15 and piston 8, tending to push the latter out of bore 7. It is prevented from doing so by a clip 18 which forms a stop.

Cut-away portions 19 in disc 15, as well as grooves 20 in the bottom of the bore permit the forwarding of gas towards passage 9.

A groove 21, at least in the needle point of rod 16, permits the outlet of gas from capsule 2 when the latter has been perforated.

Figure 3:
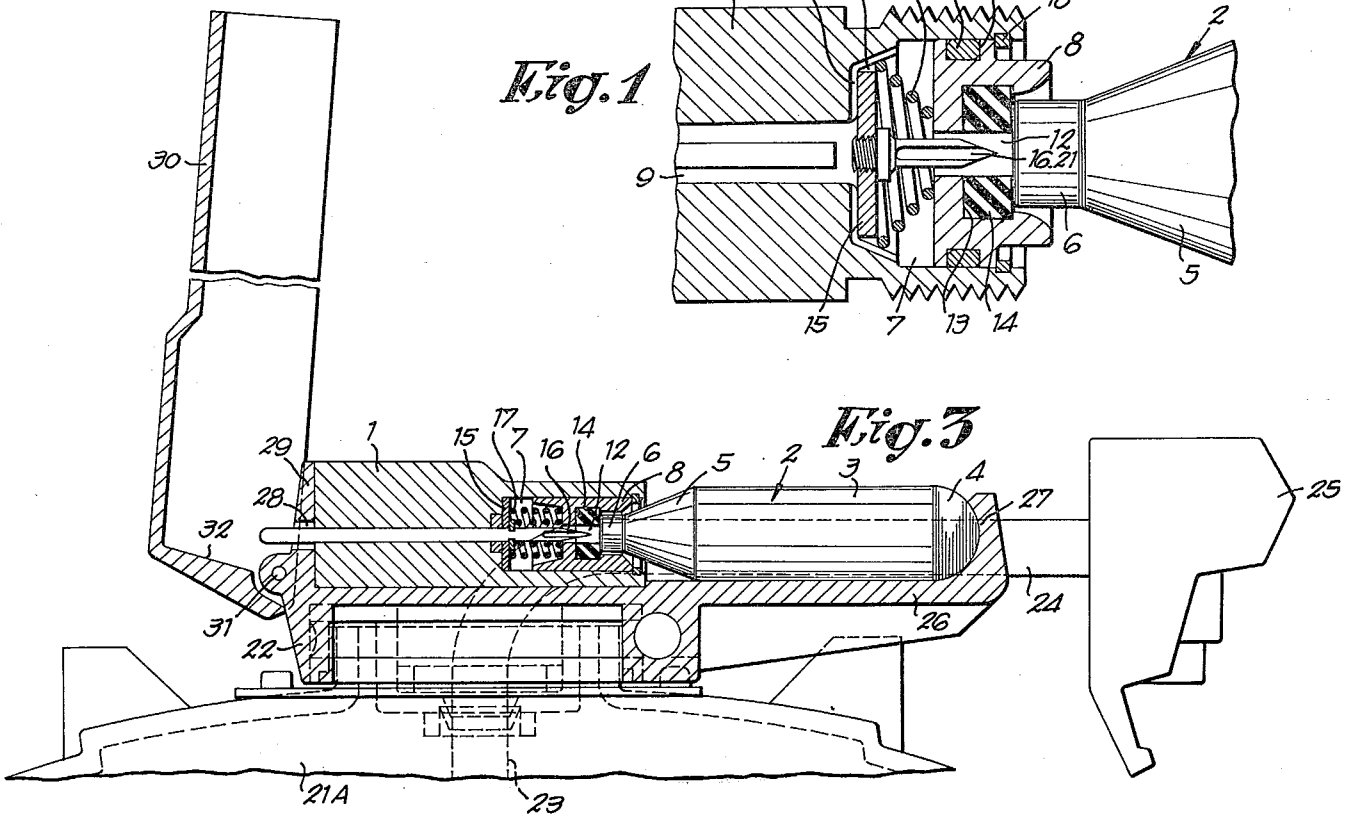
FIG. 3 is a section according to line III—III in FIG. 2, the apparatus being however shown in open position.
Figure 3:
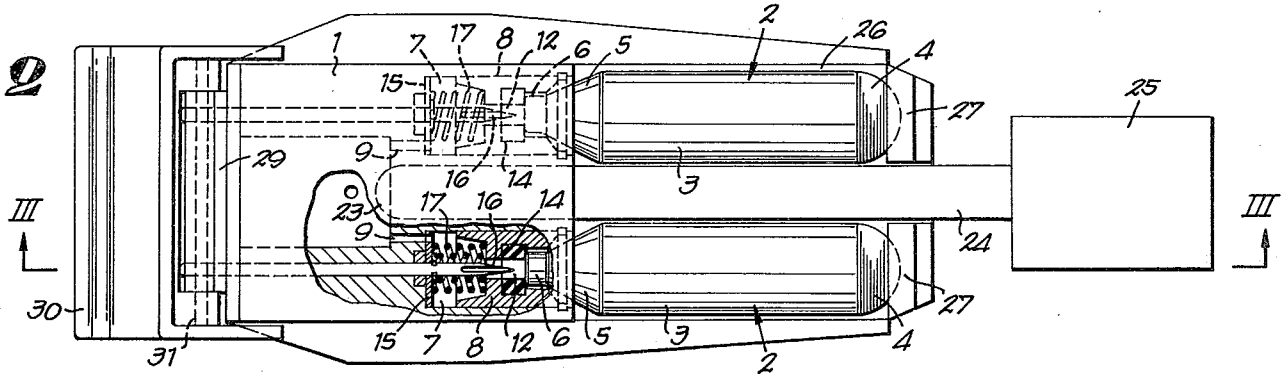
Figure 4:
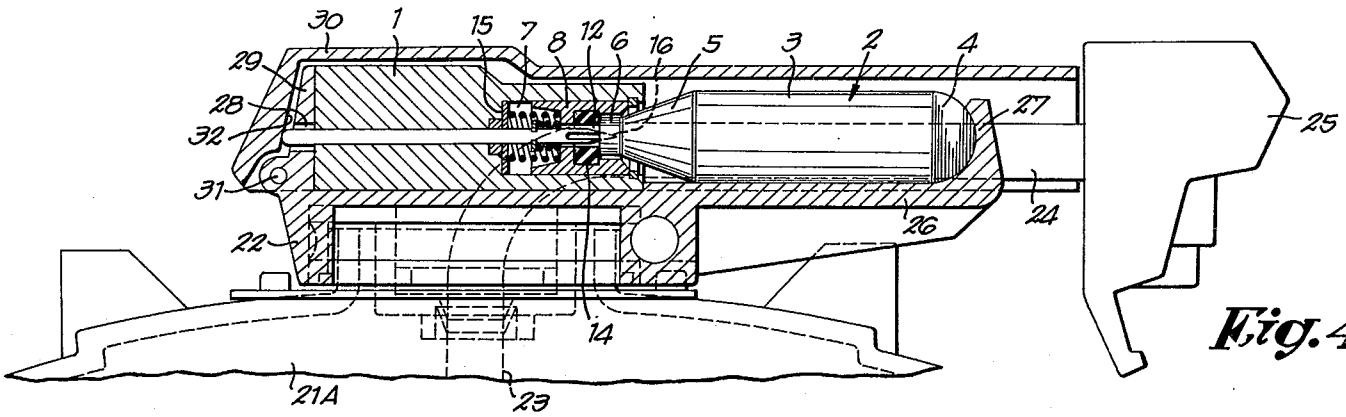
FIG. 4 is a similar view to that of FIG. 3, but with the apparatus closed and ready for use.

In the schematic example of FIG. 1, rod 16 is attached to disc 15, but it might just as well pass freely through the latter (case of FIGS. 2 to 4).

The parts being in the location shown in FIG. 1, it is obvious that if the rod 16 is brought sufficiently close to capsule 2 or conversely, the latter will be perforated so that the gas it contains will escape through groove(s) 21 into bore 7, and from there through cut-away portions 19 and grooves 20 into passage 9. Support 1 and capsule 2 are of course supposed to be solidly maintained as soon as the capsule is perforated.

The gas pressure in bore 7 acts upon piston 8, pressing the latter towards capsule 2. Sealing ring 14 is thereby firmly pressed against the annular edge of neck 6, thus assuring a perfect seal.

By selecting a sufficiently long stroke for piston 8, it is easy to compensate the differences in length which may exist between the various capsules.

FIGS. 2–4 illustrate a particularly interesting application of the above-described operating principle.

In this case it pertains to a portable drawing-off apparatus for soda drinks, intended for instance to be fitted removably on a cask 21A of plastic material.

This apparatus comprises a body 22 to which is attached a dip tube 23 which is extended by a delivery pipe 24 of which the free end is fitted with a valve 25.

This apparatus is conditioned to be able to accept two capsules located side by side. The perforating and sealing mechanisms described above have been doubled.

Support 1 for the capsules 2 is built up of an appropriate part of body 22, on the one hand, and of a metal part 26 which is born by aforesaid body, on the other hand.

This metal part 26 contains two bores 7, two pistons 8, two discs 15, two rods 16, etc.

A part 27 of body 22 forms a stop for bottoms 4 of capsules 2. Rods 16 in this case are a sliding fit in discs 15 and extend towards the outside of part 22, through openings 28 provided for this purpose in the corresponding part 29 of body 22.

Opposite this part 29, a cover 30 is fitted pivoted at 31 upon body 22, this cover being provided with a surface 32 which is capable of pressing back rods 16 on closing this cover, thus assuring the perforation of capsules 2.

It can be seen, that a subsequent opening of cover 30, whilst the apparatus is loaded, can have no detrimental consequence whatever, as the capsules 2 remain firmly pressed against the stops 27 by the pressure of pistons 8, this same pressure assuring a tight seal at the necks 6 of aforesaid capsules. It is only after the drop in pressure in bores 7, at the end of the drawing-off, that the empty capsules can easily be removed from the apparatus and replaced by full ones. It will also be seen, that the two bores 7 are interconnected. When two capsules 2 to be perforated are of considerably unequal length, the gas escaping from the capsule perforated first more firmly presses piston 8 against the other capsule. There is therefore no danger of leaks.

It is obvious that many alterations can be brought about to the above-described devices, without going beyond the scope of the invention.

What I claim is:

1. Perforating and sealing device for carbon dioxide capsules and suchlike, characterized by the fact that it comprises a capsule support; in this support, a bore for an axially moveable piston, for the purpose of capping the collar of the capsule; said piston being provided with an axial passage; a perforating element extending partially into aforesaid passage, and means for relatively moving aforesaid perforating element and the capsule towards each other until the latter is perforated, aforesaid piston being then firmly pressed against the capsule by the gas pressure in aforesaid bore.

2. Device according to claim 1, characterized by the fact that aforesaid perforating element passes through a disc which rests on the bottom of aforesaid bore, a spring being fitted between this disc and aforesaid piston.

3. Device according to claim 2, characterized by the fact that the perforating element is integral with aforesaid disc.

4. Device according to claim 2, characterized by the fact that aforesaid perforating element is a sliding fit in aforesaid disc.

5. Device according to claim 1, characterized by the fact that aforesaid means for bringing the elements together comprises a hinging cover on aforesaid support, the closing of which cover assures the movement of the perforating element towards the capsule.

6. Device according to claim 1, characterized by the fact that aforesaid axially moveable piston comprises a sealing ring against which is pressed the corresponding end of the capsule.

7. Device according to claim 1, including a body adapted to be fitted to a container, said body having two of said perforating and sealing devices arranged in side-by-side relation, and a common means for moving both perforating elements toward their respective capsules.

* * * * *